United States Patent [19]

Forbes, II et al.

[11] Patent Number: 4,690,544

[45] Date of Patent: Sep. 1, 1987

[54] BLADE CLEANING APPARATUS FOR FLEXIBLE BELT

[75] Inventors: Richard L. Forbes, II, Pittsford; Bruce E. Thorp, Walworth, both of N.Y.

[73] Assignee: Xerox Corporation, Stamford, Conn.

[21] Appl. No.: 813,183

[22] Filed: Dec. 24, 1985

[51] Int. Cl.[4] ..... G03G 15/08

[52] U.S. Cl. ..... 355/15; 355/3 DD; 355/14 D; 355/16; 118/652; 430/125

[58] Field of Search ..... 355/15, 3 BE, 16, 3 R, 355/14 D; 118/652; 430/125

[56] References Cited

U.S. PATENT DOCUMENTS

| | | | |
|---|---|---|---|
| 3,706,108 | 12/1972 | Taylor | 15/1.5 |
| 3,918,807 | 11/1975 | Hwa | 355/15 |
| 3,986,227 | 10/1976 | Fathergill et al. | 15/256.53 |
| 4,152,067 | 5/1979 | Kubota | 355/15 |
| 4,211,484 | 7/1980 | Iwai et al. | 355/15 |
| 4,407,580 | 10/1983 | Hashimoto et al. | 355/3 BE X |
| 4,425,034 | 1/1984 | Roodbergen | 355/3 BE |
| 4,499,849 | 2/1985 | Tomita et al. | 355/15 X |
| 4,501,484 | 2/1985 | Shimura | 355/15 |
| 4,505,577 | 3/1985 | Koizumi | 355/15 |
| 4,527,887 | 7/1985 | Vineski | 355/15 |
| 4,530,594 | 7/1985 | Adachi | 355/15 |
| 4,571,070 | 2/1986 | Tomita | 355/15 |

FOREIGN PATENT DOCUMENTS 1146526 7/1980 France .

*Primary Examiner*—A. C. Prescott

[57] ABSTRACT

A blade cleaning station is provided for an electrostatographic reproducing apparatus comprising an endless, flexible belt having an imaging surface thereon supported for movement between two support members defining a substantially horizontal top run therebetween. The cleaning station comprises a rigid stationary cleaning platen under the top run of the belt between the support members and a cleaning blade mounted in opposed relationship thereto on the imaging surface of the belt in interference with the imaging surface on said belt such that its beam deflection provides the force required to clean the imaging surface and the toner cleaned from the imaging surface lubricates the nip between the cleaning blade and the imaging surface.

9 Claims, 4 Drawing Figures

10
12
13
14
15
16
17
18
19
20
21
22
24
26
27
28
30
32
34
36
37
38
39
40
42
44
46
47
48
50
52
54

BLADE CLEANING APPARATUS FOR FLEXIBLE BELT

CROSS REFERENCE TO RELATED APPLICATION

Reference is made to copending application Ser. No. 773,288, entitled Blade Cleaning Apparatus for Removing Residual Toner from a Charge Retentive Surface, filed Sept. 6, 1985 in the name of Morton Silverberg.

BACKGROUND OF THE INVENTION

The present invention relates to an electrostatographic reproducing apparatus and more particularly to blade cleaning apparatus for use in cleaning an imaging surface of a endless, flexible electrostatographic imaging belt.

In an electrostatographic reproducing apparatus commonly in use today, a photoconductive insulating member is typically charged to uniform potential thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas in the photoconductive insulating area to form a powder image on the photoconductive area. This image may subsequently be transferred to a support surface such as copy paper to which it may be permanently affixed by heating or by the application of pressure.

Many commercial applications of the above process employ the use of the photoconductive insulating member in the form of a belt which is supported about a predetermined path past the plurality of processing stations to ultimately form a reproduced image on copy paper. During the imaging procedure described above, and frequently during the step of transferring toner particles to the copy sheet all the toner is not transferred and some residual toner particles remain adhering to the photoconductive surface after the transfer. Various types of devices have been used in the prior art to clean the imaging surface of this residual toner particles. Such devices include, for example, webs and brushes, foam rollers, and rotating magnets enclosed in a stationary non-magnetic belt or alternatively, stationary magnets enclosed within a rotating non-magnetic shell. In addition, blades of either the wipe or chisel type have been used to remove residual toner from the imaging surface. Cleaning blades have proved particularly satisfactory for cleaning the imaging surfaces on structurally rigid imaging drums which have been conventionally used in a number of commercial applications. This is because the blade may be mounted rigidly against the drum at virtually any position thereof to provide the necessary cleaning force to clean the residual toner. However, in the use of flexible belts supported by a plurality of rolls or arcuate members around the processing path the flexibility of design is limited for the use of a cleaning blade to be in a position adjacent to one of the rolls or arcuate members about which the belt travels to provide adequate support for the belt cleaning action. Furthermore, with the cleaning blade positioned at positions corresponding to the three o'clock, six o'clock and nine o'clock positions around the feeder path of the imaging drum or a photoconductive belt, the residual toner tends to fall away thereby increasing the coefficient of friction between the blade and the imaging surface to such a level that the edge or tip of the blade tends to tuck under thereby causing subsequent cleaning failures. Accordingly, there is a desire to provide a cleaning system for use in a machine employing a belt type photoconductor wherein the necessary force between the blade and the belt is obtained as well as adequate lubrication of the blade tip by the cleaner toner

PRIOR ART

U.S. Pat. No. 3,706,108 (Taylor) describes an apparatus for cleaning a residual image from a photosensitive member wherein a rotatable hollow core cleaning brush rotates in contact with the belt surface to be cleaned, the belt being supported in frictional contact by means of a platen 24 (FIG. 1). Alternatively, the platen can be replaced by a roller.

U.S. Pat. No. 4,527,887 (Vineski) describes a blade cleaner apparatus for a charge retentive surface which includes a lower seal 86 in contact with the photoreceptor web to insure that the cleaned or falling toner does not fall into the cleaning sump.

SUMMARY OF THE INVENTION

In a principal aspect of the present invention an electrostatographic reproducing apparatus comprising an endless, flexible belt having an imaging surface thereon supported for movement between two support members defining a substantially horizontal top run therebetween is provided with a blade cleaning station for removing residual toner particles from the imaging surface comprising a rigid stationary cleaning platen under the top run of the belt between the support members for supporting the belt thereon, and a blade mounted in opposed relationship to the cleaning platen on the imaging surface of said belt for removing residual toner therefrom, the cleaning blade being positioned in interference with the wiping surface on said belt supported by the cleaning platen such that its beam deflection provides the force required to clean the imaging surface and the toner cleaned therefrom lubricates the nip between the cleaning blade and the imaging surface.

In a further aspect of the present invention, the cleaning blade is rigidly mounted within a cleaner sump housing on top of the run of the flexible belt which housing is provided with a flexible flap seal upstream of the cleaning blade in the process direction.

In a further aspect of the present invention, the tip of the cleaning blade may be positioned directly opposite a portion of the cleaning platen or from 2 to 5 mm upstream of the cleaning platen in the process direction.

In a further aspect of the present invention, the cleaning blade may be in wiping contact or chiselling contact with the imaging surface for removing toner therefrom.

DESCRIPTION OF THE PREFERRED EMBODIMENT

The invention will now be described with reference to the preferred embodiment of the cleaning apparatus in an electrostatographic reproducing apparatus employing same.

Figure 1:
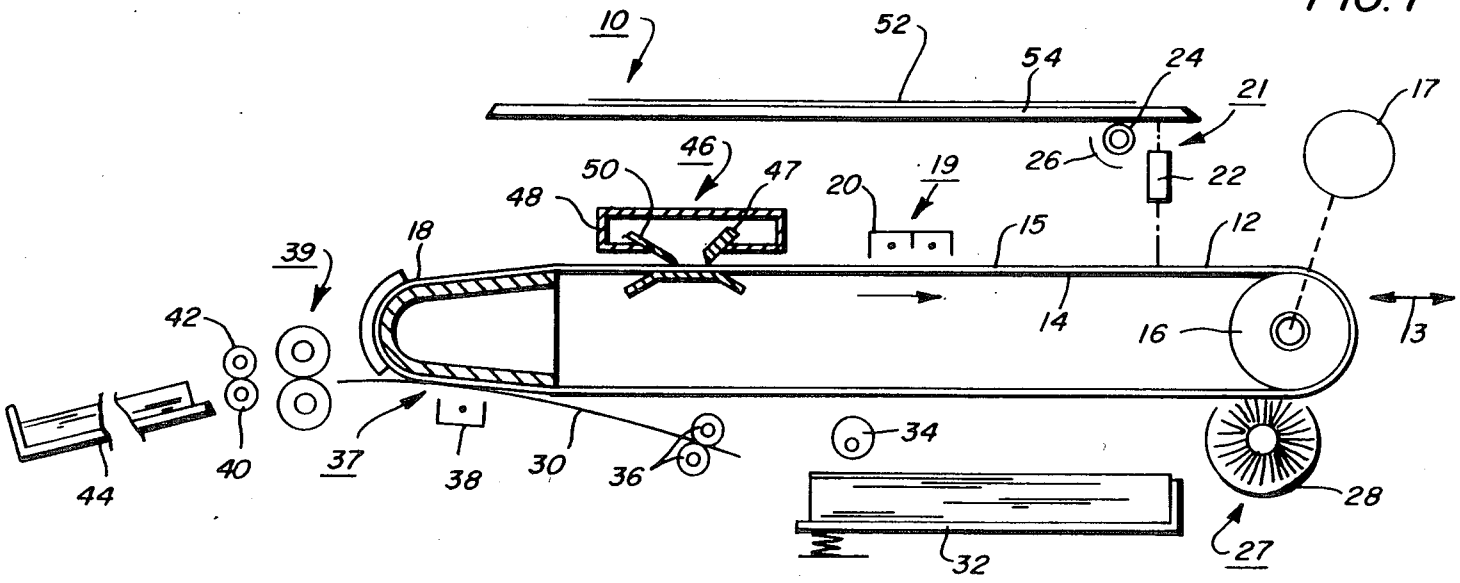
FIG. 1 is a schematic representation in cross section of an automatic electrostatographic reproducing machine with the blade cleaning apparatus according to the present invention included therein.

Referring now to FIG. 1, there is shown by way of example, an automatic electrostatographic reproducing machine 10 which includes a removable processing cartridge employing the blade cleaning apparatus according to the present invention. The reproducing machine depicted in FIG. 1 illustrates the various components utilized therein for producing copies from an original document. Although the apparatus of the present invention is particularly well adapted for use in automatically electrostatographic reproducing machines, it should become evident from the following description that it is equally well suited for use in a wide variety of processing systems including other electrostatographic systems and is not necessarily limited in application to the particular embodiment or embodiments shown herein.

The reproducing machine 10 illustrated in FIG. 1 employs a removable processing cartridge 12 which may be inserted and withdrawn from the main machine frame in the direction of arrow 13. Cartridge 12 includes an image recording belt like member 14 the outer periphery of which is coated with a suitable photoconductive material 15. The belt is suitably mounted for revolution within the cartridge about driven transport roll 16, around belt tracking shoe 18 and travels in the direction indicated by the arrows on the inner run of the belts to bring the image bearing surface thereon past the plurality of xerographic processing stations. Suitable drive means such as motor 17 are provided to power and coordinate the motion the various cooperating machine components whereby a faithful reproduction of the original input scene information is recorded upon a sheet of final support material 30, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter the belt 14 is driven to exposure station 21 wherein the charged photoconductive surface 15 is exposed to the light image of the original input scene information, whereby the charge is selectively dissipated in the light exposed regions to record the original input scene in the form of electrostatic latent image. The exposure station 21 may comprise a bundle of image transmitting fiber lenses 22 produced under the tradename of "SELFOC" by Nippon Sheet Glass Company Limited, together with an illuminating lamp 24 and a reflector 26. After exposure of the belt 15 the electrostatic latent image recorded on the photoconductive surface 15 is transported to development station 27, wherein developer is applied to the photoconductive surface of the drum 15 rendering the latent image visible. Suitable development station could include a magnetic brush development system including developer roll 28, utilizing a magnetizable developer mix having course magnetic carrier granules and toner colorant particles.

Sheets 30 of the final support material are supported in a stack arrangement on elevated stack support tray 32. With the stack at its elevated position, the sheet separator segmented feed roll 34, feeds individual sheets therefrom to the registration pinch roll pair 36. The sheet is then forwarded to the transfer station 37 in proper registration with image on the belt and the developed image on the photoconductive surface 15 is brought into contact with the sheet 30 of final support material within the transfer station 37 and the toner image is transferred from the photoconductive surface 15 to the contacting side of the final support sheet 30 by means of transfer corotron 38. Following transfer of the image, the final support material which may be paper, plastic, etc., as desired, is separated from the belt by the beam strength of the support material 30 as it passes around the arcuate face of the belt tracking shoe 18, with the sheet containing the toner image thereon which is advanced to fixing station 39 wherein roll fuser 40 fixes the transferred powder image thereto. After fusing the toner image to the copy sheet, the sheet 30 is advanced to output rolls 42 to sheet stacking tray 44.

Although preponderance of toner powder is transferred to the final support material 30, invariably some residual toner remains on the photoconductive surface 15 after the transfer of the toner powder image of the final support material. The residual toner particles remaining on the photoconductive surface after the transfer operation is removed from the belt 14 by the cleaning station 46 which comprises a cleaning blade 47 in scrapping contact with the outer periphery of the belt 14 and contained within cleaning housing 48 which has a cleaning seal associated with the upstream opening of the cleaning housing. Alternatively, the toner particles may be mechanically cleaned from the photoconductive surface by a cleaning brush as is well known in the art.

Normally when the copier is operated in the conventional mode, the original document 52 to be reproduced is placed image side down upon a horizontal transport viewing platen 54 which transports the original past the exposure station 21. The speed of the moving platen and the speed of the photoconductive belt are synchronized to provide a faithful reproduction of the original document.

It is believed that the foregoing general description is sufficient for the purposes of the present application to illustrate the general operation of an automatic xerographic copier 10 which can embody the apparatus in accordance with the present invention.

Figure 2:
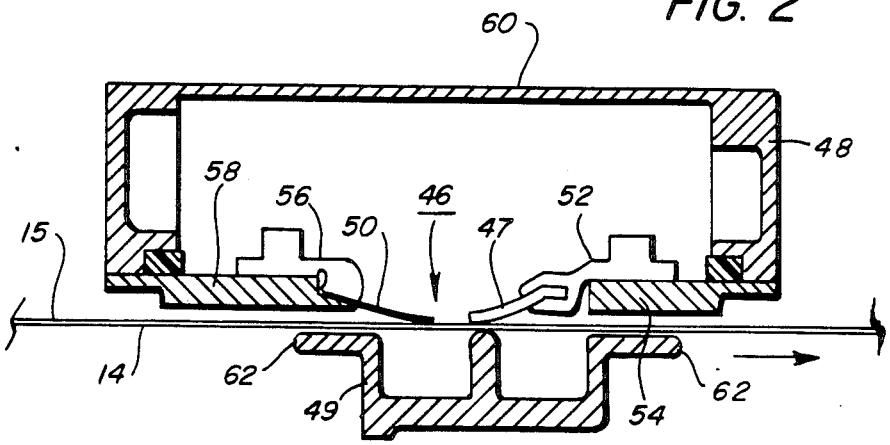
FIG. 2 is an enlarged schematic representation in cross section of the blade cleaning assembly according to the present invention.
Figure 3:
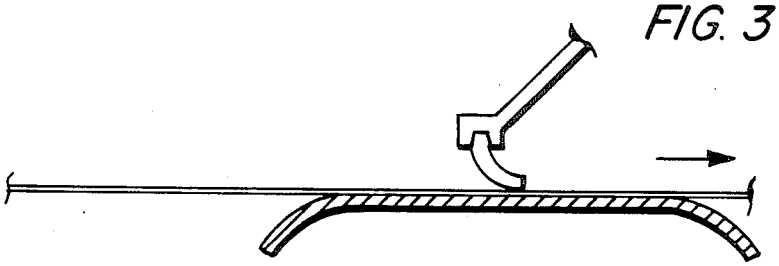
FIG. 3 is an alternative embodiment illustrating a wiping blade in opposed relationship to a horizontal platen surface.
Figure 4:
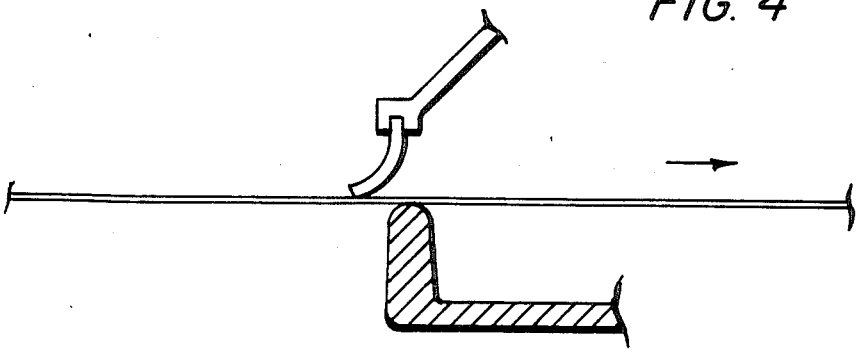
FIG. 4 is an alternative embodiment illustrating a chiselling blade positioned upstream in the process direction of the cleaning blade.

The cleaning station will be described with additional reference to FIG. 2 wherein the photoreceptor belt 14 having a photoconductive insulating surface 15 thereon is transported in the direction of the arrow through the cleaning station. The cleaning station 46 comprises a cleaning platen 49 positioned under the top horizontal run of the imaging belt 14 with a cleaning housing 48 in opposed relationship on the top run of the photoconductive belt 14. Contained within the cleaner housing is a cleaning blade 47 rigidly held in blade holder 52 which is mounted to blade mount 54 which in turn is mounted to the cleaning housing 48. The cleaning blade 47 by virtue of its position and beam deflection is in opposed interference relationship with the top surface of belt 14 supported by cleaning platen 49. Cleaning seal 50 is held by seal holder 56 which is mounted to seal mount 58 upstream in the process direction of the cleaning blade. The seal in contact with the photoreceptor 14 insures that toner cleaned from the photoreceptor by the cleaning blade 47 does not escape in the upstream direction from the cleaning housing 48. As the photoreceptor 14 travels in the direction of the arrow, any residual toner remaining thereon is cleaned or scrapped from the imaging surface by the blade 47 and transported into the cleaning sump 60. Also illustrated in FIG. 2 are structural members 62 which may be used to optionally provide additional guidance of the photoreceptor belt during transport to the cleaning station. It should be noted that the cleaning blade, cleaning platen, cleaning seal together with the cleaning housing are at least as wide as the imaging area of the photoreceptor belt. In FIG. 2, the cleaning blade 47 is in a chiselling orientation with regard to the advancing photoreceptor belt. As the belt moves in the direction indicated by the arrow, the tip of the blade 47 chisels any residual toner from the surface of the belt and pushes it up into the cleaner sump 60. An alternative embodiment is that illustrated in FIG. 3 wherein the cleaning blade is in a wiping orientation with respect to the advancing photoreceptor belt. Also illustrated in FIG. 3 is a cleaning platen 49 forming a larger area in opposed relationship to the cleaning blade. The alternative embodiment illustrated in FIG. 4 illustrates the tip of the cleaning blade being positioned from 2 to 5 mm upstream in the direction of the leading edge of the cleaning platen.

In operation in either the chiselling or wiping mode the cleaning blade which is mounted in fixed opposed relationship to the cleaning platen on the opposite side of the imaging surface, uses pressure interference engagement with the photoconductive surface of the belt by means of its beam deflection to provide the force required to clean the imaging surface of toner. In addition, in view of the orientation of the cleaning blade at roughly the twelve o'clock position, toner material which has been loosened and cleaned from the imaging surface remains in the nip between the cleaning blade and the imaging surface and lubricates the surface of the nip so that the leading edge or tip of the cleaning blade does not tuck under the main body of the cleaning blade thereby causing cleaning failures. The cleaning blade may be made of any suitable materials such as metal or plastic but preferably is made from an elastomer such as urethane. The cleaning seal may be made from a suitable material such as polyurethane, cellulose acetate or Mylar.

Thus, according to the present invention, a cleaning system for use with electrostatographic imaging apparatus employing a flexible belt containing a charge retentive surface having an imaging surface thereon is provided with a cleaning apparatus which permits enormous flexibility in architecture in that the blade does not have to be disposed adjacent to a roller, a drive roll or a backup roll. It provides a relatively simple design which could be fabricated in a most economical manner in that it omits the use of pivot springs and rotating backup roll. Furthermore it enable the blade to be positioned and accurately fixed at the time of initial assembly. This is because the blade may be rigidly mounted and clamped in place so that its deflection beam strength enables the blade to be in interference with the supported belt to obtain the normal cleaning force. In addition, the deflected blade acts as a spring and the deflected photoreceptor under the blade acts as a spring in conjunction with the belt tensioning system. The geometry also helps to open up the mechanical tolerance window of a rigid mounted cleaner system, provide optimum cleaner performance, insure belt flatness under the blade tip and allow for higher blade forces without causing the photoreceptor belt to stall. The rigid mounted blade cleaner and backup support also help to reduce cost by eliminating parts necessary to spring load and/or pivot earlier cleaning blade systems.

The disclosures of the patents referred to herein are hereby specifically and totally incorporated herein by reference.

While the invention has been described with reference to specific embodiments, it will be apparent to those skilled in the art that many alternatives, modifications and variations may be made. For example, while the invention has been illustrated with an electrostatic latent image formed by the exposure of an electrostatically charged photoconductive member to light image of an original document, the electrostatic latent image may alternatively be generated from information electronically stored or generated in digital form which may afterward be converted to alpha-numeric images by image generation and electronics and optics. Accordingly it is intended to embrace all such alternatives and modifications that may fall within the spirit and scope of the appended claims.

What is claimed is:

1. In an electrostatographic reproducing apparatus comprising an endless flexible belt having an imaging surface thereon supported for movement between two support members defining a substantially horizontal top run therebetween, a blade cleaning station for removing residual toner particles from the imaging surface comprising a rigid stationary cleaning platen under the top run of said belt between said support members for supporting said belt thereon and a cleaning blade mounted in opposed relationship to said cleaning platen on the imaging surface of said belt for removing residual toner therefrom, said cleaning blade being positioned in interference with said imaging surface on said belt supported by said cleaning platen such that its beam deflection provides the force required to clean the imaging surface and toner cleaned from said imaging surface lubricates the nip between the cleaning blade and the imaging surface.

2. The apparatus of claim 1, wherein said cleaning blade is rigidly mounted within a cleaner sump housing on top of the top run of said flexible belt.

3. The apparatus of claim 2, wherein a flexible flap seal is mounted to said sump housing upstream of said cleaning blade in the process direction.

4. The apparatus of claim 1, wherein the top of said cleaning blade is positioned directly opposite a portion of said cleaning platen.

5. The apparatus of claim 1, wherein the top of said cleaning blade is positioned from 2 to 5 mm upstream in the process direction of the leading edge of the cleaning platen.

6. The apparatus of claim 1, wherein said cleaning blade is an elastomeric material.

7. The apparatus of claim 1, wherein said cleaning blade is in wiping contact with said imaging surface for removing toner therefrom.

8. The apparatus of claim 1, wherein said cleaning blade is in chiselling contact with said imaging surface for removing toner therefrom.

9. The apparatus of claim 1, wherein said supported endless flexible belt and said blade cleaning station comprise a removable processing cartridge for said reproducing apparatus.

* * * * *